US011959360B2

(12) United States Patent
Forshaw et al.

(10) Patent No.: US 11,959,360 B2
(45) Date of Patent: Apr. 16, 2024

(54) HOLISTIC APPROACH TO HOLE CLEANING FOR USE IN SUBSURFACE FORMATION EXPLORATION

(71) Applicants: Matthew Forshaw, Celle (DE); Gerald Becker, Celle (DE); Christian Linke, Celle (DE); Sanjib Kumar Jena, Celle (DE)

(72) Inventors: Matthew Forshaw, Celle (DE); Gerald Becker, Celle (DE); Christian Linke, Celle (DE); Sanjib Kumar Jena, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 496 days.

(21) Appl. No.: 17/095,355

(22) Filed: Nov. 11, 2020

(65) Prior Publication Data

US 2021/0140274 A1 May 13, 2021

Related U.S. Application Data

(60) Provisional application No. 62/933,612, filed on Nov. 11, 2019.

(51) Int. Cl.

| | |
|---|---|
| ***E21B 37/00*** | (2006.01) |
| ***E21B 44/00*** | (2006.01) |
| ***E21B 47/022*** | (2012.01) |

(52) U.S. Cl.

CPC ..... *E21B 37/00* (2013.01); *E21B 44/00* (2013.01); *E21B 47/022* (2013.01); *E21B 2200/20* (2020.05)

(58) Field of Classification Search

CPC ..... E21B 37/00; E21B 44/00; E21B 47/022; E21B 2200/20; E21B 47/00; E21B 49/00

See application file for complete search history.

(56) References Cited

U.S. PATENT DOCUMENTS

| | | | |
|---|---|---|---|
| 4,473,124 | A | 9/1984 | Savins |
| 4,495,803 | A | 1/1985 | Beasley et al. |

(Continued)

FOREIGN PATENT DOCUMENTS

| | | | |
|---|---|---|---|
| WO | 2007130125 | A1 | 11/2007 |

OTHER PUBLICATIONS

Ozbayoglu, Evren M. et al. "Analysis of Bed Height in Horizontal and Highly-Inclined Wellbores by Using Artificial Neural Networks." Paper presented at the SPE International Thermal Operations and Heavy Oil Symposium and International Horizontal Well Technology Conference, Nov. 2002.*

(Continued)

*Primary Examiner* — Rehana Perveen
*Assistant Examiner* — Troy A Maust
(74) *Attorney, Agent, or Firm* — CANTOR COLBURN LLP

(57) ABSTRACT

Methods and systems for performing cleaning operations in boreholes penetrating earth formations are described. The methods include obtaining parameter information related to one or more angles of inclination, comparing the obtained parameter information to one or more criteria associated with each respective obtained parameter, generating a cuttings bed model based on the obtained parameter information, obtaining additional parameter information related to the one or more angles of inclination, updating the cuttings bed model in a pseudo-transient manner, determining that a hole cleaning operation is necessary, and at least one of (i) generating an indication that a hole cleaning operation is to be performed and (ii) automatically performing a hole cleaning operation.

20 Claims, 8 Drawing Sheets

(56) References Cited

U.S. PATENT DOCUMENTS

| | | | | |
|---|---|---|---|---|
| 9,567,836 | B2 * | 2/2017 | Jamison | G06F 17/10 |
| 2003/0056811 | A1 | 3/2003 | Walker et al. | |
| 2011/0069583 | A1 * | 3/2011 | Camwell | E21B 47/095 367/82 |
| 2016/0376859 | A1 * | 12/2016 | Mehrabian | E21B 44/00 175/25 |
| 2019/0309614 | A1 * | 10/2019 | Benson | E21B 49/005 |
| 2019/0316457 | A1 * | 10/2019 | Al-Rubaii | E21B 49/005 |

OTHER PUBLICATIONS

Cayeux et al., "Real-Time Evaluation of Hole Cleaning Conditions Using a Transient Cuttings Transport Model", Paper presented at the SPE/IADC Drilling Conference, Amsterdam, The Netherlands, Mar. 2013. doi: https://doi.org/10.2118/163492-MS (Year: 2013).*

International Search Report, International Application No. PCT/US2020/059940, dated Feb. 26, 2021, Korean Intellectual Property Office; International Search Report 3 pages.

International Written Opinion, International Application No. PCT/US2020/059940, dated Feb. 26, 2021, Korean Intellectual Property Office; International Written Opinion 6 pages.

* cited by examiner

HOLISTIC APPROACH TO HOLE CLEANING FOR USE IN SUBSURFACE FORMATION EXPLORATION

CROSS REFERENCE TO RELATED APPLICATIONS

This application claims the benefit of an earlier filing date from U.S. Provisional Application Ser. No. 62/933,612, filed Nov. 11, 2019, the entire disclosure of which is incorporated herein by reference.

BACKGROUND

In material or substance recovery from earth formations, drilling operations are performed. During drilling operations, an annulus between a pipe and borehole can become clogged with drill cuttings or otherwise impacted. However, during drilling processes, operators aim to manage 'hole cleaning', ensuring that cuttings created during the drilling process are efficiently transported up the annulus (i.e., entrained in the drilling fluid) to surface. Failure manage such cuttings removal can result in a build-up of cuttings in a variety of sections of the wellbore (i.e., beds of cuttings). These beds of cuttings may result in annular constriction which can mechanically impact drill string movements, potentially leading to stuck pipe events. Annular constrictions can also cause increases in circulating pressures which can lead to formation damage. Poor hole cleaning can be mitigated by proper modification of surface drilling parameters and fluid rheological parameters during the real-time execution phase. In pre-well planning phases, mitigation may also take place through avoidance of sections with prolonged tangents at bore hole inclinations that are hard to transport cuttings.

Remediation of poor hole cleaning may be referred to as sweep or sweep/pill operations. In such operations, a high viscosity "pill" is mixed, circulated down the inside of the drill string, out through a bottom hole assembly, and then back up through the annulus of the borehole. Such operations tend to be time consuming and may require multiple operators and/or personnel to control and monitor multiple different aspects of a downhole operation and systems related thereto. Accordingly, performing a sweep operation may be time consuming and potentially inconsistent.

The principles of hole cleaning as a drilling process are generally considered to be well understood, and both the accurate diagnosis during the drilling operation and the means to either mitigate or remediate the issue exist. While significant technological advances regarding detection of hole cleaning dysfunctions have been made in various individual approaches. However, improvements may be made to such approaches.

SUMMARY

Systems and methods for method for performing a cleaning operation in a borehole penetrating an earth formation are described.

The methods include obtaining parameter information related to one or more angles of inclination, comparing the obtained parameter information to one or more criteria associated with each respective obtained parameter, generating a cuttings bed model based on the obtained parameter information, obtaining additional parameter information related to the one or more angles of inclination, updating the cuttings bed model in a pseudo-transient manner, determining that a hole cleaning operation is necessary, and at least one of (i) generating an indication that a hole cleaning operation is to be performed and (ii) automatically performing a hole cleaning operation.

The systems include one or more sensors configured to obtain parameter information related to one or more angles of inclination, a control system configured to (i) received the parameter information from the one or more sensors, (ii) compare the obtained parameter information to one or more criteria associated with each respective obtained parameter, (iii) generate a cuttings bed model based on the obtained parameter information, (iv) obtain additional parameter information related to the one or more angles of inclination, (v) update the cuttings bed model in a pseudo-transient manner, and (vi) determine that a hole cleaning operation is necessary, and the control system is further configured to at least one of (i) generate an indication that a hole cleaning operation is to be performed and (ii) automatically control and perform a hole cleaning operation.

BRIEF DESCRIPTION OF THE DRAWINGS

The following descriptions should not be considered limiting in any way. With reference to the accompanying drawings, like elements are numbered alike.

The detailed description explains embodiments of the present disclosure, together with advantages and features, by way of example with reference to the drawings.

DETAILED DESCRIPTION

A detailed description of one or more embodiments of the disclosed apparatuses and methods presented herein are presented by way of exemplification and not limitation, with reference made to the appended figures.

Disclosed are methods and systems for performing automatic hole cleaning and/or sweep operations in downhole systems and/or remediation of poor hole cleaning operations. Various embodiments are provided to enable automatic and/or partially automatic mechanisms related to sweep operations to enable improved and/or more efficient sweep operations. For example, embodiments provided herein are directed to a holistic, automated, and digital approach to monitoring for when and how a hole cleaning or sweep should be performed. That is, in accordance with some embodiments, a holistic and aggregated approach combining multiple different criteria, considerations, and/or methodologies to enable improved monitoring for hole cleaning criteria and provide hold cleaning risk identification. Further, embodiments of the present disclosure are directed to early detection and warning related to hole blockage or clog events, thus enabling early remediation, and also potentially eliminating secondary operations related to hole clogs, blockages, and/or obstructions, during drilling operations.

Figure 1:
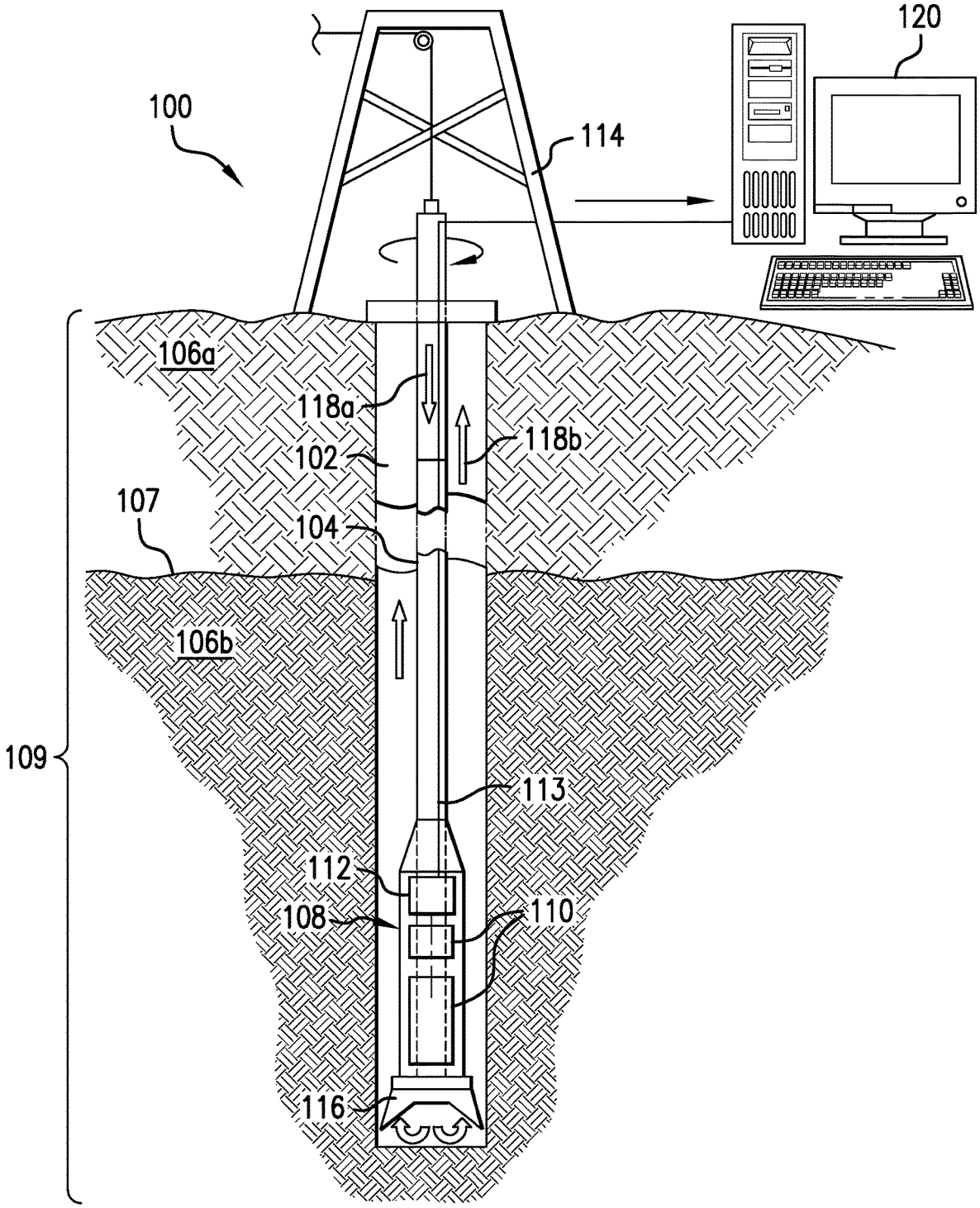
FIG. 1 is a schematic illustration of an embodiment of a drilling system in accordance with an embodiment of the present disclosure.

Referring now to FIG. 1, a non-limiting schematic illustration of a drilling system 100 associated with a borehole 102 is shown. A drill string 104 is run in the borehole 102, which penetrates the earth 109, having, as shown, one or more earth formations 106*a*, 106*b*. The drill string 104 includes any of various components to facilitate subterranean operations. In various embodiments, the drill string 104 is constructed of, for example, pipe, drill pipe, coiled tubing, multiple pipe sections, wired pipe, flexible tubing, or other structures, as known in the art. The drill string 104 is configured to include, for example, a bottom-hole assembly (BHA) on a downhole end thereof. The BHA can be configured for drilling operations, milling operations, measurement-after-drilling pass operations, etc. Further, as will be appreciated by those of skill in the art, sections of the drill string 104 can include various additional features, components, and/or configurations, without departing from the scope of the present disclosure. For example, in a non-limiting example, the drill string 104 can include heavy-weight drill pipe, push pipe, etc.

The system 100 and/or the drill string 104 may include any number of downhole tools 108 for various processes including measuring drilling vibrations, directional drilling information (magnetometers, accelerometers), and formation evaluation sensors (FE sensors) and/or instruments for measuring one or more physical properties, characteristics, quantities, etc. in and/or around the borehole 102. For example, in some embodiments, the downhole tools 108 include a drilling assembly (e.g., a mud motor or a rotary steerable). Various measurement tools can be incorporated into the system 100 to affect measurement regimes such as measurement-while-drilling (MWD), and/or logging-while-drilling (LWD) applications. In some embodiments, the downhole tools 108 may be part of and/or form a BHA, and in other embodiments, the downhole tools 108 may comprise elements in addition to and/or beyond those that form the BHA.

While the system 100 may operate in any subsurface environment, FIG. 1 shows the downhole tools 108 disposed in the borehole 102 penetrating the earth 109 (including a first formation 106*a* and a second formation 106*b*). In other configurations, the system 100 may be arranged for offshore exploration, as will be appreciated by those of skill in the art. The downhole tools 108 are disposed in the borehole 102 at a distal end of the drill string 104. As shown, the downhole tools 108 include measurement tools 110 and downhole electronics 112 configured to perform one or more types of measurements in logging-while-drilling ("LWD") or measurement-while-drilling ("MWD") applications and/or operations. The measurements may include measurements related to drill string operation (accelerometer, strain gauge), for example.

A drilling rig 114 is configured to conduct drilling operations such as rotating the drill string 104 and, thus, a drill bit 116 located on the distal end of the drill string 104. Additionally, as shown, the drilling rig 114 is configured to pump drilling fluid 118*a* through the drill string 104 in order to lubricate the drill bit 116. The drilling fluid 118*a* becomes a flushing fluid 118*b* to flush cuttings from the borehole 102. In some embodiments, the drilling fluid 118*a* may be configured to drive a mud motor or similar mechanism, and may enable non-rotating drilling of the borehole 102.

The downhole electronics 112 are configured to generate data, i.e., collect data, at the downhole tools 108. Raw data and/or information processed by the downhole electronics 112 may be telemetered along telemetry connection 113 to the surface for additional processing or display by a computing system 120. In some embodiments, telemetry connection 113 may include mud pulse in a fluid column inside the drill string 104, acoustic transmission in a wall of the drill string 104, transmission along wires located within the drill string 104, electromagnetic transmission through the formations 106*a*, 106*b*, and/or any other means of conveying information between downhole and surface. In some configurations, drilling control signals are generated by the computing system 120 and conveyed downhole to the downhole tools 108 or, in alternative configurations, are generated within the downhole electronics 112, or by a combination thereof. The downhole electronics 112 and the computing system 120 may each include one or more processors and one or more memory devices, in addition to other electronics and/or electrical components, as known in the art.

Different layers or formations of the earth 109 may each have a unique resistivity, acoustic properties, nuclear properties, etc. For example, the first formation 106*a* may have a first resistivity and the second formation 106*b* may have a second resistivity. Depending on the compositions of the first formation 106*a* and the second formation 106*b*, the first resistivity may be different from the second resistivity. In order to measure and/or detect these resistivities, and thus extract information regarding the formations 106*a*, 106*b*, and/or an interface 107 therebetween, the downhole tools 108 are configured to obtain electromagnetic information. Accordingly, the downhole tools 108 include one or more transmitters (transmitter coils) that turn a current impulse in a transmitter coil on and off to induce a current in the earth 109 (e.g., formations 106*a*, 106*b*). One or more receivers are configured to receive a resulting electromagnetic signal. Those of skill in the art will appreciate that the transmitter(s) and receiver(s) may be one-, two-, or tri-axis devices, and/or other transceiver devices may be employed without departing from the scope of the present disclosure. In some embodiments, the transmitters may be configured with electromagnets and/or switchable permanent magnets to induce currents in the earth 109.

Electromagnetic investigation is only one of many types of formation analysis, as known in the art. Other types of analyses may be employed to determine different properties and/or characteristics of the formations 106*a*, 106*b* and/or the earth 109 around the borehole 102. Some analyses may include, without limitation, nuclear magnetic resonance, acoustic travel time, pressure, nuclear density, formation sampling, gamma ray, core sampling, optical sampling and/or investigation, etc., as will be appreciated by those of skill in the art.

Figure 2:
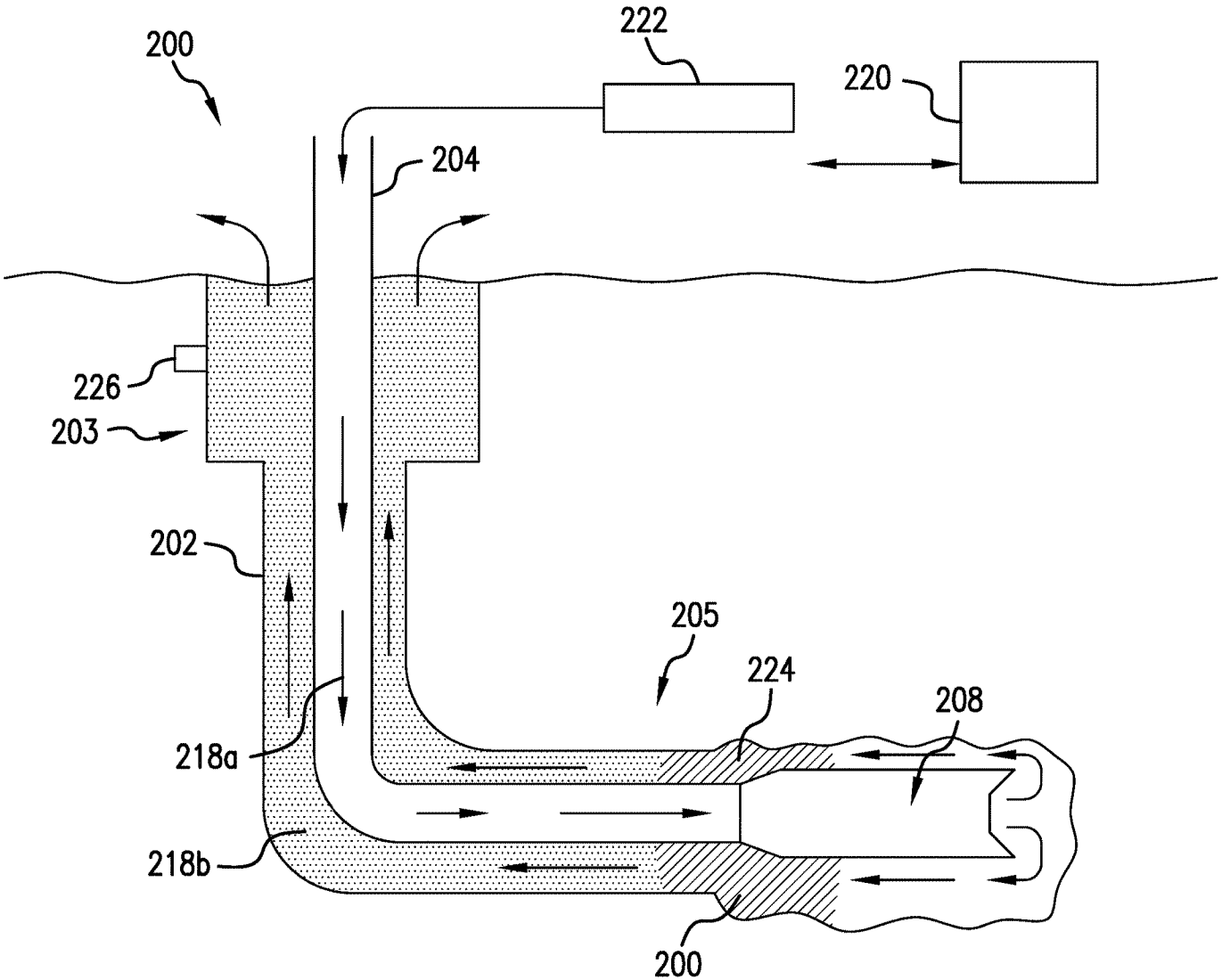
FIG. 2 is a schematic illustration of an embodiment of another downhole drilling, system in accordance with an embodiment of the present disclosure.

Turning now to FIG. 2, a schematic illustration of a system 200 including downhole tools disposed in the earth in accordance with an embodiment of the present disclosure is shown. The system 200 may include various features shown and described above with respect to FIG. 1, and may be a downhole drilling system. As shown in FIG. 2, a downhole tool 208 includes a drill bit on a distal end thereof and is configured as part of a bottom hole assembly (BHA). The downhole tool 208 is located on the end of a drill string 204 within a borehole 202. As shown in FIG. 2, the drill string 204 may extend through a marine riser 203 and includes a horizontal extension or section 205.

During drilling operations using the downhole tool 208, a drilling fluid 218*a* is pumped through the drill string 204. If a mud motor (not shown) is included in the BHA, then a mud flow can be used to drive rotation of the bit downhole. As the bit engages with the material of the earth, cuttings are generated. The cuttings are then carried out of the borehole 202 by the drilling fluid (indicated as flushing fluid 218*b*). Occasionally hole cleaning is carried out to clean or clear an annulus of the borehole 202 to ensure proper fluid flow and drilling operations. For example, hole cleaning may be necessary in horizontal extensions 205 of a borehole 202 because removal of the cuttings may not be as efficient as in a vertical borehole. If the cuttings are not adequately removed, various impacts may be experienced, including, but not limited to pipe sticking, bit wear, slowed drilling, formation fracturing, excessive torque and/or drag on the drill string 204, difficulties in logging and/or cementing, difficulties in casings landing, etc. Accordingly, a hole cleaning operation enables and/or ensures efficient and effective drilling operations. However, hole cleaning may be inefficient, based on various factors, and thus poor-hole-cleaning remediation may be required.

One process to remediate poor hole cleaning is a sweep process of conveying a "pill" through the drill string, out through the bottom hole assembly (e.g., through the bit), and then through the annulus between the drill string 204 and a wall of the borehole 202. The pill is a mud or other fluid that has different properties than the drilling fluid. For example, the pill may be a mixture of different materials that provides a viscous fluid that when passed through the annulus of the borehole 202 is configured to remove the cuttings out of the annulus. For example, as shown in FIG. 2, a pill mixing and deployment system 222 is arranged at the surface and is configured to inject a pill 224 into the drill string 204. The pill mixing and deployment system 222 can include sources of various materials to be mixed to make the pill 224 and further include pumps and/or other injection devices and/or components to drive the pill 224 into the drill string 204 (interior to the drill string 204), through the downhole tools 208 (including a drill bit), and then through the annulus within the borehole 202 (exterior to the drill string 204). As shown in FIG. 2, the pill 224 is schematically located near the downhole tool 208 in the annulus of the borehole 202. The arrows of FIG. 2 show the flow path of the pill 224 through the drill string 204 and then up through the annulus of the borehole 202.

Sweeps of pills through drilling bottom hole assemblies and up the annulus such as for hole cleaning are traditionally triggered and performed manually. The triggering may be based on an operator monitoring one or more criteria to determine if a sweep (or other hole cleaning process) is necessary. The operator may use a computer system 220 to monitor one or more properties and/or characteristics of the drilling process to determine when a hole cleaning operation should be performed. The computer system 220 can monitor surface and downhole conditions to determine if a hole cleaning operation or a sweep/pill operation should be conducted, can be used to engage and/or perform the sweep/pill operation, and can monitor the progress of the sweep/pill operation.

In accordance with embodiments of the present disclosure, the computer system 220 can be configured to automatically evaluate (e.g., constantly, continuously, at specific intervals, on-demand, etc.) the need for remediation of poor hole cleaning operation (e.g., modification of surface drilling parameters, modification of the rheology of the drilling fluid system, or the need for a specific remediation method such as a high-viscosity sweep, a wiper trip, or back-reaming). The evaluation can include both technical and nontechnical perspectives. In some embodiments, the computer system 220 and/or a program/application thereof can be advisory in nature. An advisory program may include notification to operators or other personnel that a hole cleaning operation is recommended based on characteristics that have been detected within the drilling system. The computer system 220 is configured to receive real-time measurements and/or modeled data in order to monitor and make decisions (e.g., provide advice regarding hole cleaning operation and/or automatically start a hole cleaning operation or other automated remediation measures). The real-time measurements use surface or downhole sensors providing real-time data, such as, and without limitation, pressure, temperature, flow rate, torque, weight on bit (WOB), string RPM, depth, hook-load, bending, inclination, azimuth, and/or viscosity.

The computer system 220 can be configured or arranged to control or enable control of pumps, actuators, and/or other controls or devices of system 200 that are configured to control a fluid flow through the drill string 204, fluid flow through the borehole 202, measurement operations, and/or drilling operations. That is the computer system 220 can be a monitoring system, data collection-aggregation-processing system, and/or control system. In some embodiments, the computer system 220 may be a single computer system and in other embodiments may be configured as a collecting of different computer components and/or systems, as will be appreciated by those of skill in the art. The computer system 220 may be located at surface or, in alternative embodiment, may be at least partially located downhole inside the BHA.

Embodiments described herein are directed to improved hole cleaning for drilling operations, including, without limitation, real-time modelling, surface and downhole direct measurements with intelligent agents, and offset experience. In accordance with some embodiments described herein, these various components and considerations (and/or others) can be aggregated by an automated high-level process to produce a result akin to that of an experienced human at the wellsite. Further, rather than relying on a human operator, embodiments described herein may be fully automated and/or enable continuous updating and monitoring of a drilling operation, including monitoring for and predicting hole blockage situations or events and enabling remedial action in a timely and efficient manner. Several of the 'component' services detailed herein, including topics within torque and drag, cuttings bed modeling, and pressure regime modelling are advances on current practice. Additionally, the concept of exploring aggregated multiple point-source findings in accordance with embodiments described herein (e.g., computer system) provide a framework that has significant potential when automating the detection of other drilling dysfunctions.

At a very high level, cuttings bed modelling enables accurate depiction of the size and location of beds in the wellbore, and how this evolves over time. This means being able to show both the deposition and erosion of beds dynamically, based on the current operating parameters. Monitoring of such models, when they are taken out of their predominant legacy residence of the pre- and post-well planning and analysis phases of wellbore construction, and placed in the real-time drilling world, can provide some benefits to determining hole cleaning events. Embodiments of the present disclosure are directed to aggregating the modeled data with other signals and/or information from the wellbore. Much like the modeling, there is considerable understanding on the various criteria that allow early identification of inadequate hole cleaning. In accordance with some embodiments, the coupling/relationship between the above criteria may be employed in an automated and computerized process. For example, embodiments of the present disclosure may simultaneously monitor multiple signals with respect to the criteria, while having planning, historical, and/or offset data to allow the process to make an informed and accurate decision (e.g., notification, automated action/response, alarm, etc.) regarding hole cleaning and bed depositions, wherein the monitored multiple signals are analyzed with respect to the various criteria being fulfilled. That is, embodiments of the present disclosure are not siloed into just making judgement on a single, yet heavily interdependent, signal or dataset.

One example of such aggregation and consideration is provided. Expected annular pressure measurements, performed by a pressure sensor, for both circulating and static equivalent mud densities may be observed. This would suggest a low level of cuttings loading in the annulus. However, if only the pressure measurements, such as performed by a pressure-while-drilling service, are considered, then an incorrect conclusion may result (i.e., no aggregation of other data/considerations). For example, what if, in fact, there had been an increasing trend in high RPM viscometer readings (viscosity data) of the drilling fluid, the models supplied with operational parameters in real-time were suggesting an inadequate annular flow rate, and on the last three connections pick-up weights gradually increasing were observed. All of these are key criteria of cuttings beds building in horizontal sections. However, if a system is able to define and/or implement the couplings/relationships between the various criteria, alongside machine enabled automatic monitoring of real-time signals/information, a machine-performed hole cleaning risk identification service may be provided by embodiments of the present disclosure.

As such, embodiments of the present disclosure provide identification and may provide remedial advice regarding hole cleaning. Further, advantageously, embodiments of the present disclosure may mitigate second level drilling events such as cuttings avalanches, pack-offs etc., which may be significant events that may contribute to drilling downtime. Embodiments described herein are directed to automating identification services and response to hole cleaning and events or situations related thereto. To achieve such automation and processing, physics-based modelling is employed to enable pseudo-transient modelling techniques that are employed in real-time. The real-time modelling described herein may be digitally aggregated to provide a service for hole cleaning.

As used herein, certain terms will be employed and a definition of such terms is provided, in context, of the terms "steady-state" and "transient" modelling. Steady-state modelling is where the state variables which define the system are constant over time. In steady-state modeling, the beginning and end are well-known but it is difficult to quantify the behavior of variables in the interim period (i.e., between the beginning and the end). A steady-state is generally only reached after a period of initialization. In contrast, transient modelling is defined as the simulation of a process where the primary criterion is time. When a variable changes, the system is in a state of flux until a point when both the inputs and the outputs become stable and steady-state is once again achieved. To relate, and to give context to the models described, steady-state models for hole cleaning have long been in existence and used for modelling cuttings build-up and erosion during the drilling process. There are, for example, four mathematical components considered within these common (steady-state) models: Herschel-Buckley rheological model for drilling fluids; actual and required annular velocity calculations; particle slip velocity for scenarios with and without circulation; and lift factors induced by pipe eccentricity and rotation. As used herein, the term "simulation" includes, at least, one of steady-state modelling, pseudo-transient modelling, and transient modelling.

Figure 3:
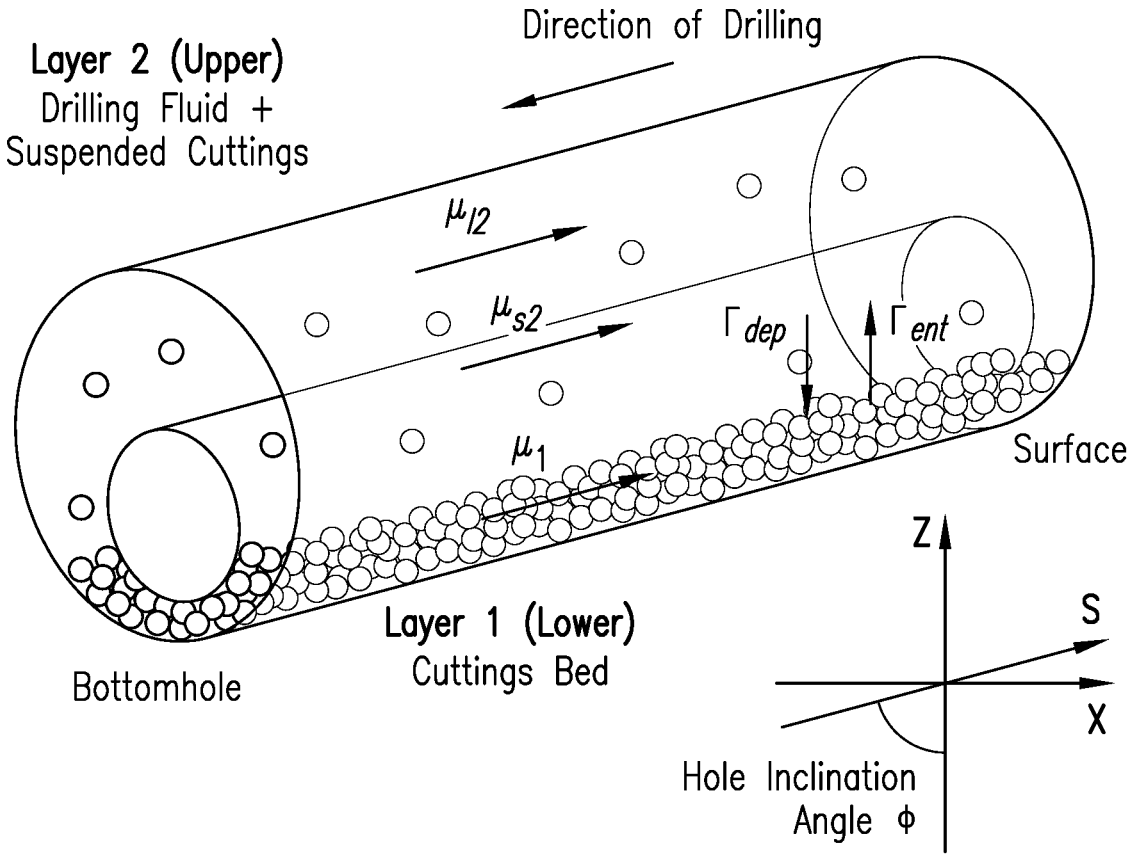
FIG. 3 is a schematic illustration of cuttings beds within a borehole.

A requirement of a transient hole cleaning model is the ability to divide the annular space in the wellbore into several layers, and model the mass balance and force exerted between each layer. Simplistically, as an example, the wellbore may be divided into two layers. A first or lower layer consisting of a stationary cuttings bed (e.g., deposited cuttings and material, relatively stationary solids) and a second or upper layer that includes the drilling fluid and cuttings currently suspended within the drilling fluid (i.e., moving fluid through the wellbore). This is schematically shown in FIG. 3.

Greater in complexity is a three-layer (unsteady) model, which consists of an upper suspension layer (moving fluid), as with the two-layer model, a dispersed layer of cuttings (moving fluid), and a uniform layer at the base (relatively stationary). The mathematics required to resolve steady or un-steady three-layer models are significantly more complex than the mathematics required for resolving the two-layer models and therefore require more processing capacities.

Figure 4:
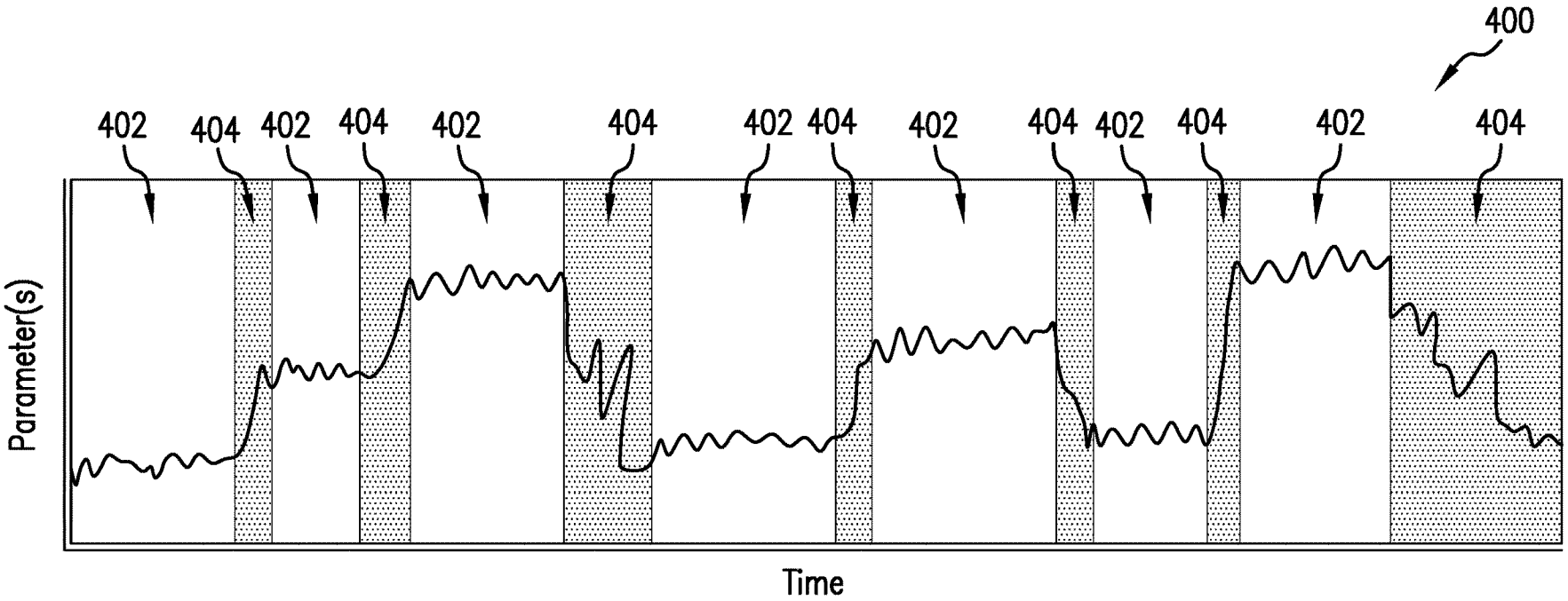
FIG. 4 is a schematic plot of different periods of operation during a drilling operation.

Turning to FIG. 4, as an example, a plot 400 of surface flow-in (i.e., the primary control for hole-cleaning during a drilling process) versus time is shown. In the plot 400, the surface flow-in parameter is divided into sections that can be modelled by a steady-state model (sections 402) and sections which require transient modelling (sections 404). As shown, in the steady-state sections 402, the parameter(s) are substantially constant, but in the transient sections 404, the parameters transition (i.e., transition from one steady-state section 402 to a subsequent steady-state section 402).

Although full transient models are not currently available or are not mature/developed enough, embodiments of the present disclosure are directed to real-time steady-state modelling (i.e., pseudo-, near-, or almost-transient modeling). The steady-state modeling may be performed in a repetitive manner to produce a "pseudo-transient model." Simply put, in the context of the above depiction, if the state of the cuttings bed in the wellbore at any point in time is to be known, the history of the system must be considered. This can be achieved by continuously iterating steady-state modelling and then populating a buffer with simulation (modelling) results. One simulation result may be the cuttings bed height along at least a portion of the depth of the borehole.

The limitations of steady-state models become apparent when deployed in real-time. As the models assume steady-state conditions valid for a state of equilibrium, the moment that any of these variables changes, then the model in use will react instantaneously. For example, if flow is increased, the simulation will react/respond with an increase in annular velocity, and therefore a reduction in cuttings bed height in the annulus. The reduction is achieved because of the increased flow rate. The time taken to arrive at a new steady-state is not an output of the model that is available. So while, in a real-time monitoring scenario, while it is known that the new parameters will prevent further accumulation of beds or erode beds currently in place, the system/model is unable to forecast this with respect to time. This is the time-limitation of steady-state modeling. Real-time use of steady-state models effectively provides a polarity indicator, informing on whether or not the current parameters will, if kept constant, worsen or remediate cuttings beds/depositions when compared with the previous iteration of the calculation.

The solution presented in accordance with embodiments of the present disclosure is born out of the definition of a steady-state model, in that input parameters must remain constant to arrive at a steady-state. For example, starting with a completely clean wellbore, and cuttings are generated with all relevant input parameters for the model remaining constant (e.g., surface flow in, ROP, mud rheology, etc.) then after a predefined period of time (t), the cuttings beds output by the model will be achieved, in place in the actual wellbore. Assuming time (t) is known, if the time (t) is divided by the cycle time for the real-time model, the number of model iterations before equilibrium state (i.e., steady-state) is achieved may be determined.

However, it has been recognized that there are some limitations to this approach. For example, the time (t) which determines a buffer size (Bytes) and, therefore, has an indirect effect on erosion and deposition is an estimate. That is, the time (t) it is not a direct output of the model. Further, it is assumed that a standard rate of erosion of beds is present if the required annular velocity to prevent cuttings beds first building in the section is exceeded. Furthermore, it is assumed that once the cuttings are eroded from the bed they were originally deposited in that they are entrained in the annular flow (suspension layer) and carried out of the wellbore, and not redeposited further up the wellbore. It is noted that the second limitation does not pertain to erosion of beds already in place, as beds that are in place will constrict or lessen the annular cross-sectional area and therefore are expected to actually increase the annular velocity to a level above which the model is predicting. The time (t) may be estimated based on experience and derived knowledge of the system (e.g., by an experienced human) or may be dynamically calculated by an algorithm using operational parameters (e.g., mud flow, RPM, WOB, ROP, fluid properties, etc.), well bore parameters (e.g., borehole diameter, inclination, depth, etc.), rig parameters (e.g., rig, location, drill string/BHA diameter, bit type, etc.), or formation parameters (e.g., lithology, etc.). In some non-limiting embodiments, the time (t) may be 1 min to 5 hours. In some alternative non-limiting embodiments, the time (t) may be 5 min to 3 hours. In yet other non-limiting embodiments, the time (t) may be 10 min to 1 hour. The buffer size may change during a drilling run with changing operational conditions (e.g., well size, depth, fluid flow, etc.). With changing operational conditions, deposition of cuttings beds may occur at different time scales. As the time (t) determines the buffer size, the buffer size may be adapted accordingly (e.g., a dynamic buffer size).

In accordance with some embodiments of the present disclosure, a positive feedback loop process is provided. In one non-limiting example, a process may include checking for flow circulation. Upon detecting flow circulation, a hydraulics calculation is performed to determine if cuttings are being generated at-bit (i.e., on-bottom drilling). If cuttings are being generated, the process may determine if the depth of the borehole is equal to the bit-depth, if so, then the process may execute a hydraulics simulation with hole cleaning, and if not, the process may execute a hydraulics simulation without hole cleaning. That is, if cuttings are being generated, hole cleaning may be simulated, and if cutting are not being generated, hole cleaning may not be necessary. This enables the tracking and monitoring of bed heights within a borehole.

When hole cleaning simulation is performed, an array for cuttings bed height values (data) may be generated and/or published. This enables arrays holding values related to bed height to be generated at progressing time, thus further enabling tracking cuttings bed height development and a positive feedback loop. When no hole cleaning is simulated no update or new cuttings bed height data is necessary within the process.

A moving average is performed on the cuttings bed height arrays published at different times. A buffer is used to store the arrays of cuttings bed height values. The array of cuttings bed height values holds cuttings bed height data along the well path depth. When a new cuttings bed height array is calculated by the simulation, this new value array may be added to the buffer. Accordingly, a tracking of cuttings bed height over time (and potentially in real-time or near real-time) may be achieved. With an updated buffer and value array regarding cuttings bed heights, the process may wait a predetermined time period to start the process again. This time period may also be referred to as repetition time period ($t_r$). The repetition time period $t_r$ refers to a frequency of performing steady-state simulations within a positive feedback loop. That is, the process may return to monitoring or checking for circulation and/or a flow greater than zero after a repetition time period ($t_r$). The predetermined repetition time period ($t_r$) may be any period of time as set by an operator or through other determination process. In some non-limiting examples, the predetermined time period may be 10 seconds, 15 seconds, 30 seconds, etc.

Figure 5:
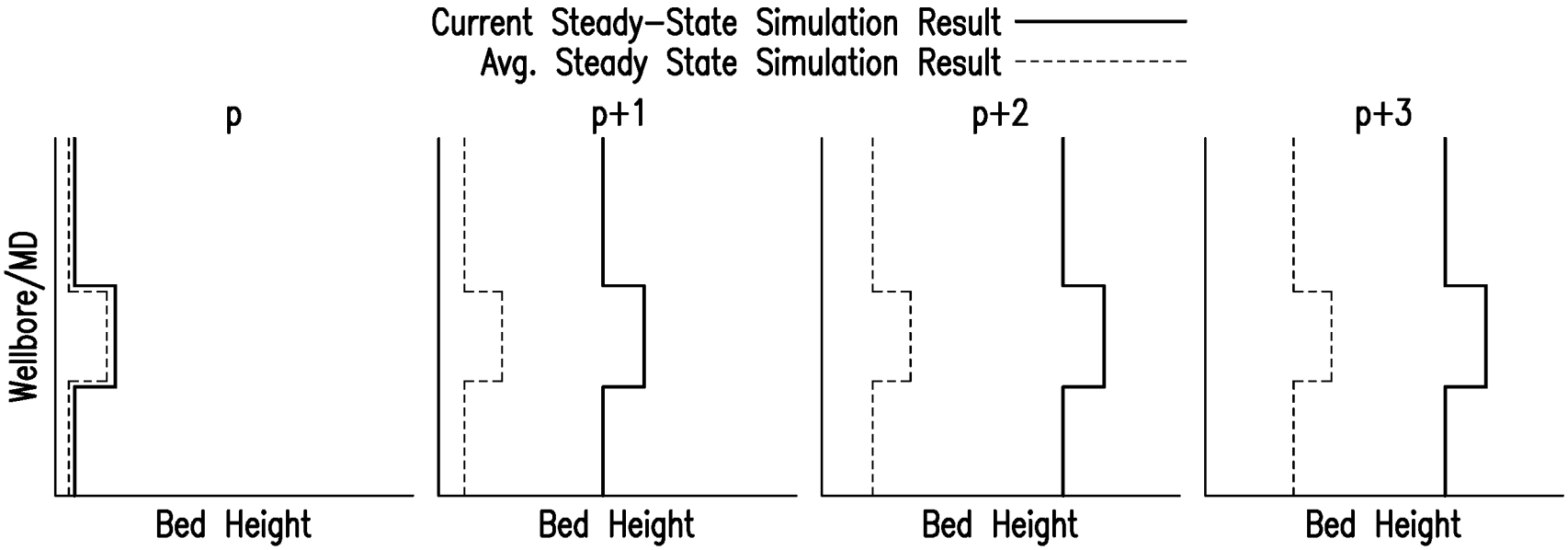
FIG. 5 is a plot of pseudo-transient modelling at a frequency based on a predetermined time period in accordance with an embodiment of the present disclosure.

FIG. 5 demonstrates a pseudo-transient modelling (e.g., process of repeated simulations) at a frequency based on the predetermined time period ($t_r$) in accordance with an embodiment of the present disclosure. An initial steady-state simulation result (array of cuttings bed height values) using a steady-state model is written to the buffer. After the predetermined time period ($p*t_r$) the next steady-state simulation is performed, and the next array is written to the buffer. A first average is calculated with the initial steady-state simulation result to provide a first averaged steady-state simulation result. After another increment of the predetermined time period ($(p+1)*t_r$) the next steady-state simulation is performed and the next array is written to the buffer. A second average is calculated with the first averaged steady-state simulation result. This process makes the steady-state simulation running in real-time and maintains a fixed number of steady-state simulation results being averaged at any point in time. The averaging may be calculated by adding single simulation results and divide by the number of added simulation results. In alternative embodiments, a running or moving averaging may be used. In yet another embodiment, weighted averaging may be used.

In FIG. 5, the initial (left-most) plot shows a single steady state simulation result at time increment (p) upon initiation of the hole cleaning service. As the service has just been initiated this first steady-state simulation result is added to a buffer which is pre-filled with zero values (e.g., 0% cuttings bed heights), as there are no previous simulations. A first average is calculated. At the time increment (p+1) a first change in surface parameters occurs which results in a second simulation result different to the first simulation result (second from left plot). The second simulation result is written to the buffer. In this case the second simulation result was higher than the first simulation result. This increases the second average of cuttings bed height calculated by averaging the first average (p) and the second simulation result (p+1). A second change in surface parameters at time increment (p+2) results in a third even higher simulation result (third from left plot). As in the previous iteration step of the service, this is written to the buffer and the calculated third average is calculated based on the second average and third simulation result. With no variation in surface parameters between the third iteration and the fourth iteration the fourth simulation result remains the same as the third simulation result. The simulation result remains constant. However, the calculated fourth average cuttings bed height, calculated by averaging the third average and the fourth simulation result, grows compared to the third average.

If there is no hole cleaning simulation run, and no bed height data generated for an iteration, a further determination may be performed. For example, a determination of whether the current flow detected is sufficient to remove in-place cuttings beds. For example, one check or comparison may be is 95% of the flow-in greater than or equal to a required flow rate. The required flow rate may be determined from a prior iteration of the process—i.e., based on the buffer data, cuttings bed height, prior flow rate, etc. Alternatively, the required flow rate may be based on a separate simulation related to drilling simulations. If it is determined that the flow rate is sufficient (i.e., 95% or greater) then the cuttings bed data may not be adjusted, and thus the buffer (of the entire depth) may be set to the prior level (i.e., no change). However, if the flow rate is less than 95% (in this example), then the previous cuttings bed height array may be held. In either case, the process may then proceed to wait the predetermined time period. The published cuttings bed height is added to the buffer if it is considered for averaging (pseudo-transient behavior), if not, the buffer is held in its previous state.

Figure 6:
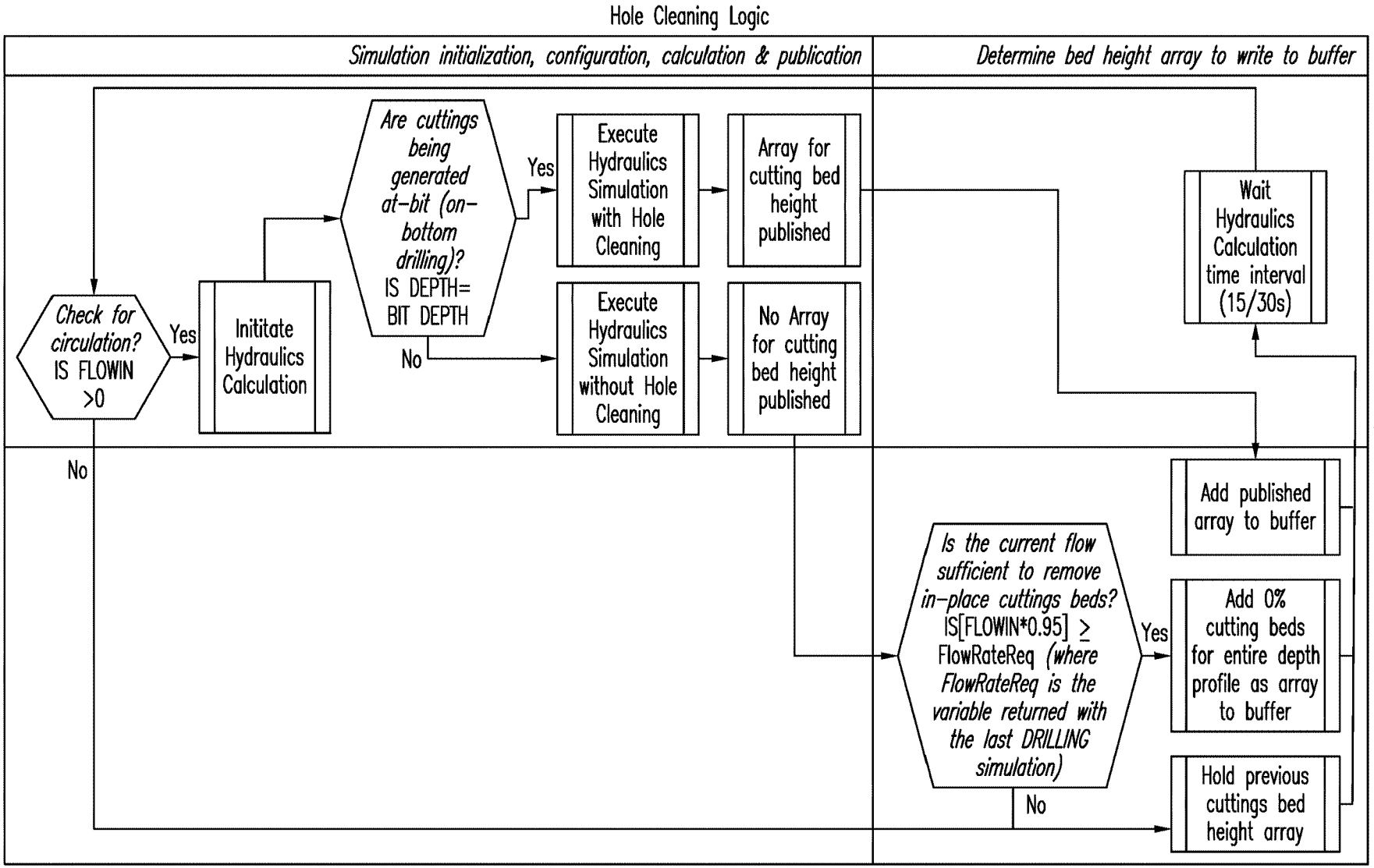
FIG. 6 is a schematic plot/flow process in accordance with an embodiment of the present disclosure.

FIG. 6 provides a schematic plot/flow diagram representative of the above described process that may be employed by some embodiments of the present disclosure.

In the above described and shown process, the input parameters for the hydraulics simulation running in real-time (or near real-time) can be separated into two broad categories. The first category is static or semi-static and the second category is real-time. The static or semi-static category of input parameters are those which do not, or may not, change during the course of a drilling run. This may also be generally referred to as the fixed or semi-fixed environment. The static or semi-static input parameters, for example, includes, without limitation, the drilling rig properties, the surface location thereof, the drill string (including both dumb-iron (drill pipes, stabilizers, jars, etc.) and BHA and related parameters such as geometry and mechanical and material properties), wellbore geometry (e.g., casing, liner, borehole diameter, casing diameter, etc.).

In contrast, real-time input parameters are those which are altered or changed during the course of a drilling run. The changes may include changes in the surface operating parameters and can include, without limitation, rate of penetration (ROP), flow-in rates, revolutions per minute (RPM), weight-on-bit (WOB), etc. Changes may also be made to the drilling fluid or mud, with either the density or rheology properties being altered. Real-time input parameters also include downhole logging data (e.g., LWD data, MWD data, etc.)

Furthermore, there is some amount of overlap between the two categories of input parameters. Such overlap parameters may include fluid properties (e.g., density, temperature, rheology), formation properties (e.g., geology, formation temperature, formation pressure, etc.), and trajectory (e.g., depth, inclination, etc.). The specific category into which these may fall may depend on the definition of real-time or near real-time. However, as used herein, the term "real-time" refers to parameters which are updated during a real-time execution phase of the process.

As new values become available, with varying frequency, the new values can be overlaid on those used in the last iteration of the calculation/simulation. This can be used in pre-well phase simulations, the last iteration of the real-time simulation, etc. These iterations of the steady-state hole cleaning simulation are what populate the buffer as discussed above.

Figure 7:
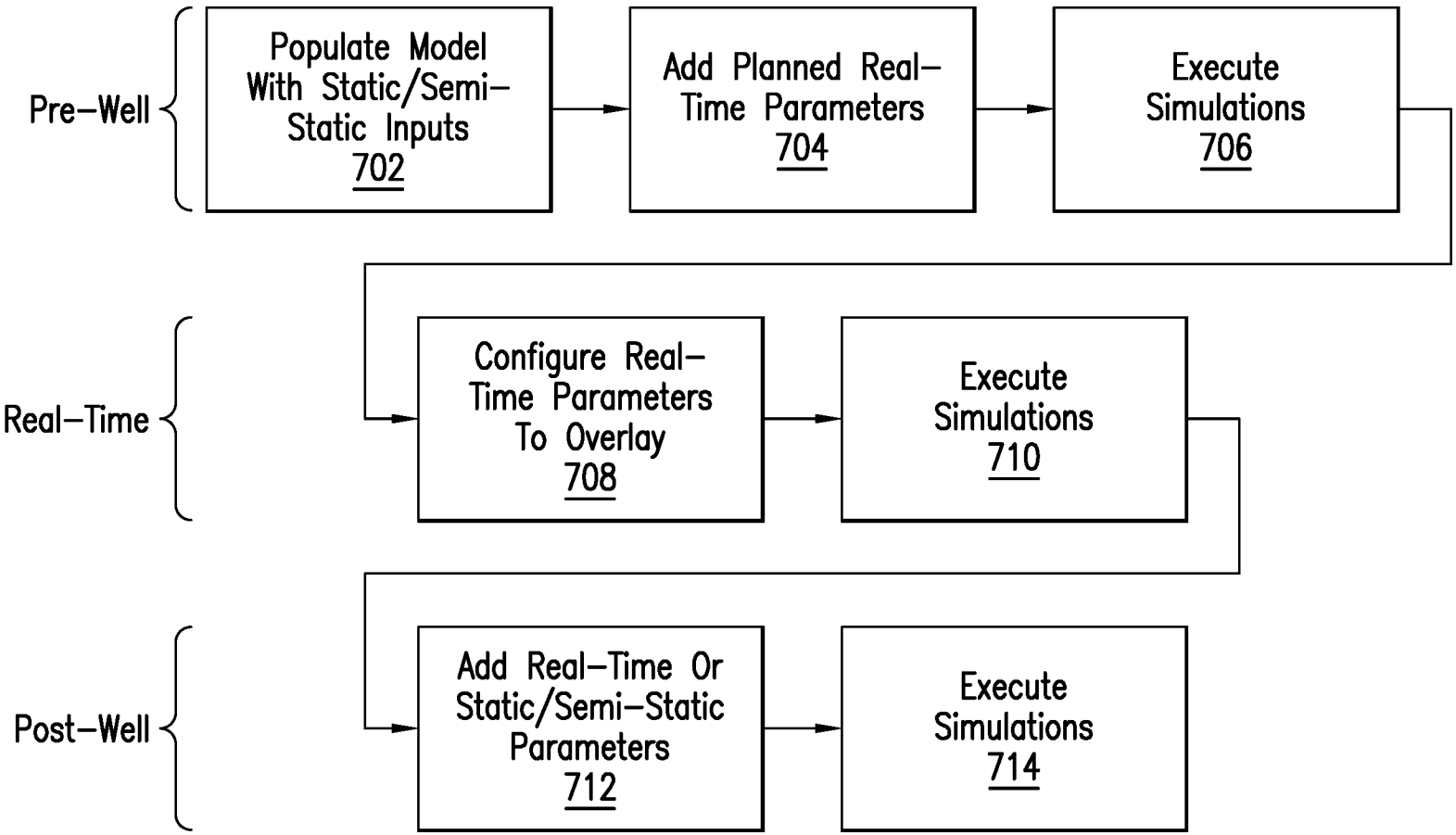
FIG. 7 is a flow process in accordance with an embodiment of the present disclosure.

FIG. 7 illustrates an overall process in accordance with an embodiment of the present disclosure. In FIG. 7, all aspects of a subsurface operation are included, including, for example, pre-well planning, real-time drilling, and post-well operations. As shown, the real-time portion (i.e., during drilling operations) may be performed in a cyclical process, as described above, using a positive feedback loop.

Block 702 represents static/semi-static parameters, including, for example, drillstring and BHA components as well as wellbore geometry. The static/semi-static parameters are defined as the parameters that do not change during run-time. Block 704 represents a set of planned real-time parameters are envisaged surface operating parameters in the pre-well phase. Examples of such planned real-time parameters are planned flow, fluid properties, RPM etc. Block 706 represents using the planned real-time parameters in conjunction with the static/semi-static parameters to run simulations. Block 708 represents that, once in the real-time phase, planned operational parameters can be overlaid automatically with measured parameters that are measured by sensors connected to the surface acquisition system. Block 710 represents the running of simulations that are executed on a timely basis based on a defined trigger logic. Blocks 712 and 714 represent, in a post-well phase, the activities conducted in the pre-well phase that can be replicated.

Advantageously, embodiments of the present disclosure may employ a steady-state simulation with a moving average thereof. This allows for the modeled cuttings beds heights in the wellbore to evolve over time, without the need of a true transient hole cleaning model.

Figure 8:
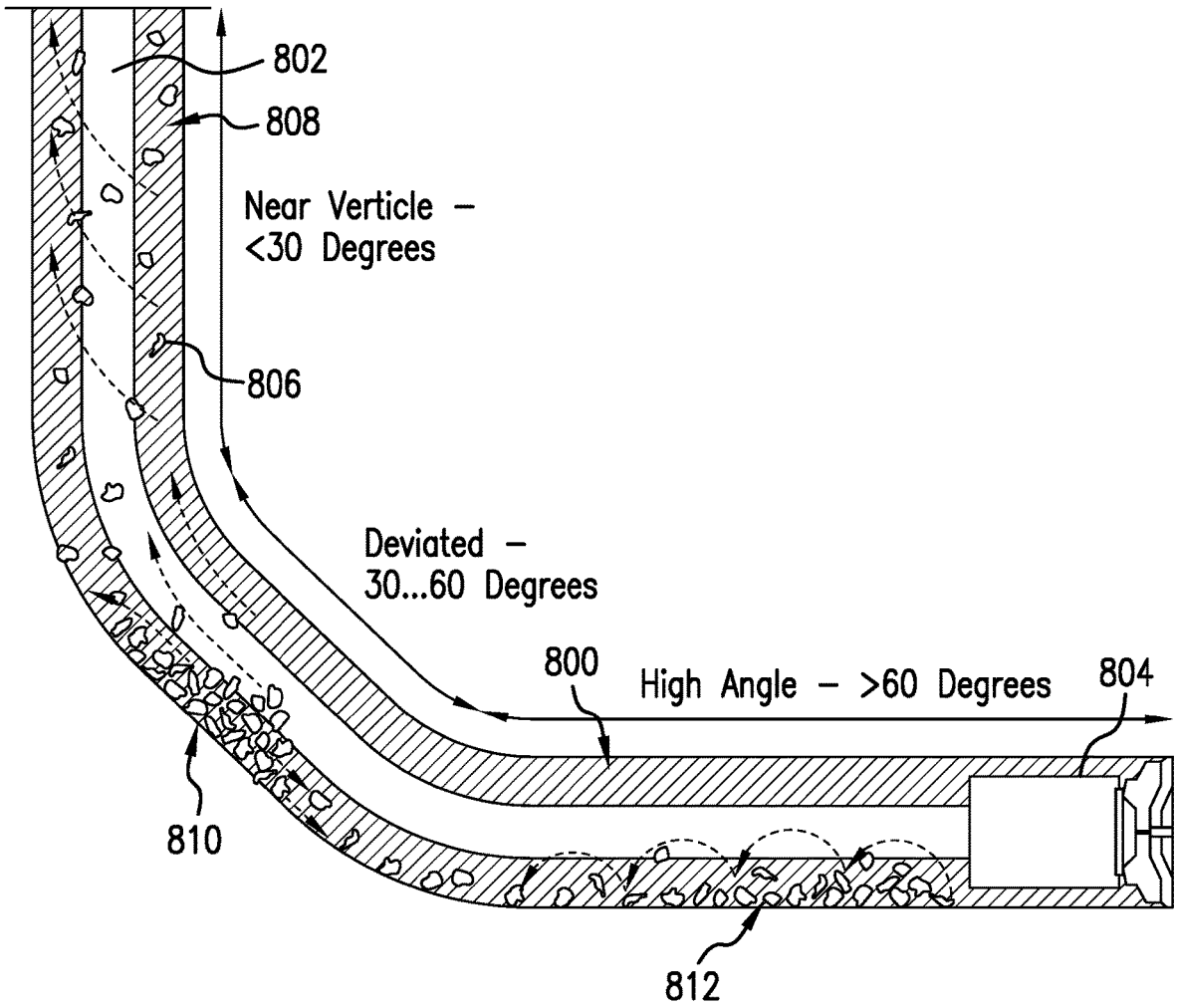
FIG. 8 is a schematic illustration of cuttings disposition within different borehole orientations or inclination angles.

It is noted that different hole cleaning methods may be necessary for the geometry of the wellbore/borehole. For example, a vertical hole may require or have different properties, parameters, and requirements than a horizontal hole. FIG. 8 illustrates the different aspects of subsurface bore hole 800 that may be drilled using a drill string 802 having a disintegrating device 804 (e.g., drill bit) disposed on an end thereof. In this illustration, the borehole 800 has three separate sections: near vertical; deviated; and high angle. The near vertical portion of the borehole 800 may have an inclination angle of less than 30° relative to a strictly vertical line from a surface point (i.e., along a plumb line). The deviated portion may have an inclination angle of between 30° and 60°. The high angle portion may be a portion of the borehole 800 having an inclination angle of greater than 60° (sometimes referred to as a horizontal section). Within the near vertical portion, cuttings 806 may be suspended 808 within a drilling fluid. In the deviated portion, the cuttings 806 may be subject to saltation and sliding 810. In the high angle portion, the cuttings 806 may be subject to saltation 812.

Because of this, the simulation and hole cleaning for each section may require specific modeling and simulation and may have separate parameters related thereto. That is, during a real-time or near real-time modeling/simulation (e.g., pseudo-transient modelling) in accordance with the present disclosure, active accounting of the specific geometry of different portions of a borehole may be accounted for.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

As described above, embodiments of the present disclosure are directed to automating borehole cleaning operations, and specifically identifying properties of a borehole to determine when and how hole cleaning should be performed. In aspects of the disclosure, models are updated in a transient or pseudo-transient manner (i.e., over time), with different properties monitored to enable an optimal cleaning schedule. Multiple different models may be employed to provide a holistic approach, and each model or a parameter of each model can include one or more criteria/threshold, which are determined at different inclination angles.

In accordance with some embodiments, mutual independent algorithmic agents monitor parameters that can be divided into three main categories, (i) surface parameters, (ii) downhole parameters, and (iii) rheological parameters. Surface parameters include surface pump pressure, pick-up (PU), slack-off (SO), rotating-off bottom drag and rotating-off bottom torque (T&D ROB), and drilling torque. Downhole parameters include equivalent circulation density (ECD), equivalent static density (ESD), and differential pressure across the bit. Rheological parameters include drilling fluid density and viscosity (Fann 75 300 RPM, Fann 75 600 RPM). The algorithmic agents may be referred to as cuttings bed height agent 1, cuttings bed height agent 2, etc., surface agent 1, surface agent 2, etc., downhole agents 1, downhole agent 2, etc., and/or rheological agent 1, rheological agent 2, etc. For each of the monitored parameters defined criteria are used to identify deposition of cuttings beds at different inclination sections of the borehole.

The borehole may be divided into a number of inclination sections based on survey inclination angles along the well path. A probability index of occurrence of a bad borehole cleaning event is determined for each of the possible inclinations. One algorithmic agent monitor cuttings bed height and use as a criterion the cuttings bed height criticality for each of the inclination sections. The cuttings bed criticality uses the integrated cuttings bed height over the depth interval of an inclination section. The integration uses the cuttings bed height previously simulated by using the pseudo-transient modelling. The integrated cuttings bed height in an inclination section is considered critical if it exceeds a pre-defined threshold for the cuttings bed height at the respective inclination. The threshold for cuttings bed heights is defined differently for different inclination sections. For example, the threshold for a 30°-60° inclination section may be lower than in other inclination sections due to the risk of cuttings bed avalanching. One cuttings bed height agent monitors the average cuttings bed height resulting from the pseudo-transient modelling to see if the threshold is exceeded. Beside the simulated cuttings bed height, the other agents monitor other parameters that contribute to a bad hole cleaning event and that are associated with other criteria. A matrix may be used to define how the various criteria used by the different agents contribute to the identification of a hole cleaning event. The matrix can include weighting factors for different criteria and different inclinations. There may be, for example, twelve (12) different criteria beside the criteria for the simulated cuttings bed height over six (6) inclination ranges (e.g. 0-10°, 10°-30°, 30°-60°, 60°-80°, 80°-90°, and >90°). It will be appreciated that other matrix configurations are possible. The weighting factors for various independent criteria and agents may vary depending on the inclination. The matrix is used to calculate a probability index of occurrence of a bad borehole cleaning event. In addition to the weights of different criteria in different inclination sections, a moving time window may be used for each criterion. The time window sizes for the different criteria may be defined differently depending on the longevity of adverse effects on hole cleaning. Depending on the time window sizes, the criteria may be weighted differently when contributing to the calculated probability index of occurrence of a bad borehole cleaning event.

The transient/pseudo-transient nature of modeling as described herein and updating such models (and/or simulations) provides a new and more accurate approach that is improved over prior operator-determined hole cleaning. Further, embodiments described herein enable automation of hole cleaning and thus provides for improved and more timely/responsive hole cleaning when needed. Moreover, when such hole cleaning is performed, the hole cleaning operation may be catered to specific properties or parameters based on an inclination angle of the borehole and/or other considerations.

In accordance with some embodiments of the present disclosure, the holistic approach aggregates one or more of: continuous potential cuttings bed modeling; torque and drag; measurement-while-drilling equivalent circulating density; measurement-while-drilling equivalent static density; surface fluid parameter monitoring; and along-the-string pressure regime modeling.

As such, methods for performing hole cleaning in downhole operations are provided. The methods include obtaining downhole parameter information related to one or more angles of inclination and comparing the obtained downhole parameter information to one or more criteria associated with each respective obtained downhole parameter. A cuttings bed height model of downhole conditions based on the obtained downhole parameter information is generated and additional downhole parameter information related to the one or more angles of inclination is obtained. The cuttings bed height model is then updated in a pseudo-transient manner. Based on the updated beds model, a determination regarding the execution or performance of a hole cleaning operation is made. Based on this determination, a system may perform at least one of (i) generating a notification to an operator to perform a hole cleaning and (ii) automatically performing a hole cleaning operation based on at least one of (i) the updated beds model, (ii) the downhole parameter information, (iii) the additional downhole parameter information, and (iv) the one or more criteria associated with each respective obtained downhole parameter.

Embodiment 1: A method for performing a cleaning operation in a borehole penetrating an earth formation, the method comprising: obtaining parameter information related to one or more angles of inclination; comparing the obtained parameter information to one or more criteria associated with each respective obtained parameter; generating a cuttings bed model based on the obtained parameter information; obtaining additional parameter information related to the one or more angles of inclination; updating the cuttings bed model in a pseudo-transient manner; determining that a hole cleaning operation is necessary; and at least one of (i) generating an indication that a hole cleaning operation is to be performed and (ii) automatically performing a hole cleaning operation.

Embodiment 2: The method of any preceding embodiment, wherein the automatic performing of the hole cleaning operation is based at least one of (i) the updated beds model, (ii) the parameter information, (iii) the additional parameter information, and (iv) the one or more criteria associated with each respective obtained parameter.

Embodiment 3: The method of any preceding embodiment, wherein the parameter information related to the one or more angles of inclination is separated into information related to at least one of (i) a near vertical portion, (ii) a deviated portion, and (iii) a high angle portion.

Embodiment 4: The method of any preceding embodiment, wherein the near vertical portion is a portion of the borehole having an angle of inclination of 30° or less relative to vertical.

Embodiment 5: The method of any preceding embodiment, wherein the deviated portion is a portion of the borehole having an angle of inclination of between 30° and 60° relative to vertical.

Embodiment 6: The method of any preceding embodiment, wherein the high angle portion is a portion of the borehole having an angle of inclination of 60° or greater relative to vertical.

Embodiment 7: The method of any preceding embodiment, wherein the parameter information comprises at least one of torque and drag, equivalent circulating density, equivalent static density, surface fluid parameter, and pressure.

Embodiment 8: The method of any preceding embodiment, wherein the parameter information comprises static or semi-static parameters.

Embodiment 9: The method of any preceding embodiment, wherein the static or semi-static parameters include, at least one of drillstring component data and wellbore geometry.

Embodiment 10: The method of any preceding embodiment, wherein the parameter information comprises at least one of planned flow, fluid properties, and RPM.

Embodiment 11: A system for performing a cleaning operation in a borehole penetrating an earth formation, the system comprising: one or more sensors configured to obtain parameter information related to one or more angles of inclination; a control system configured to (i) received the parameter information from the one or more sensors, (ii) compare the obtained parameter information to one or more criteria associated with each respective obtained parameter, (iii) generate a cuttings bed model based on the obtained parameter information, (iv) obtain additional parameter information related to the one or more angles of inclination, (v) update the cuttings bed model in a pseudo-transient manner, and (vi) determine that a hole cleaning operation is necessary; and the control system is further configured to at least one of (i) generate an indication that a hole cleaning operation is to be performed and (ii) automatically control and perform a hole cleaning operation.

Embodiment 12: The system of any preceding embodiment, wherein the automatic controlling and performing of the hole cleaning operation by the control system is based at least one of (i) the updated beds model, (ii) the parameter information, (iii) the additional parameter information, and (iv) the one or more criteria associated with each respective obtained parameter.

Embodiment 13: The system of any preceding embodiment, wherein the parameter information related to the one or more angles of inclination is separated into information related to at least one of (i) a near vertical portion, (ii) a deviated portion, and (iii) a high angle portion.

Embodiment 14: The system of any preceding embodiment, wherein the near vertical portion is a portion of the borehole having an angle of inclination of 30° or less relative to vertical.

Embodiment 15: The system of any preceding embodiment, wherein the deviated portion is a portion of the borehole having an angle of inclination of between 30° and 60° relative to vertical.

Embodiment 16: The system of any preceding embodiment, wherein the high angle portion is a portion of the borehole having an angle of inclination of 60° or greater relative to vertical.

Embodiment 17: The system of any preceding embodiment, wherein the parameter information comprises at least one of torque and drag, equivalent circulating density, equivalent static density, surface fluid parameter, and pressure.

Embodiment 18: The system of any preceding embodiment, wherein the parameter information comprises static or semi-static parameters.

Embodiment 19: The system of any preceding embodiment, wherein the static or semi-static parameters include, at least, drillstring component data, BHA component data, and wellbore geometry.

Embodiment 20: The system of any preceding embodiment, wherein the parameter information comprises at least one of planned flow, fluid properties, and RPM.

The systems and methods described herein provide various advantages. For example, embodiments provided herein represent a significant advance in the automatic handling of sweeps/pills and/or the alteration of surface or fluid properties. This allows for the reduction of non-production time while drilling a borehole and delivers a quality borehole that can be completed to deliver production.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" do not denote a particular order, but are used to distinguish different elements.

The flow diagram depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for performing a cleaning operation in a borehole penetrating an earth formation, the method comprising:

obtaining, using a sensor, parameter information related to one or more angles of inclination;

generating a cuttings bed model based on the obtained parameter information, the cuttings bed model providing a first array of cuttings bed height-related values for a portion of a depth of the borehole, the cuttings bed height-related values in the first array varying with the depth of the borehole, the portion of the depth of the borehole including the one or more angles of inclination;

obtaining, using the sensor, additional parameter information related to the one or more angles of inclination;

updating the cuttings bed model in a pseudo-transient manner using the additional parameter information, the updating the cuttings bed model in the pseudo transient manner including updating the cuttings bed model after a repetition time to provide a second array of cuttings bed height-related values for the portion of the depth of the borehole, the cuttings bed height-related values in the second array varying with the depth of the borehole;

comparing the first array of cuttings bed height-related values to the second array of cuttings bed height-related values;

determining that a hole cleaning operation is necessary based on the comparing; and performing the hole cleaning operation.

2. The method of claim 1, wherein the hole cleaning operation includes a sweep pill operation.

3. The method of claim 1, wherein the parameter information and the additional parameter information are separated into information related to at least one of (i) a near vertical portion, (ii) a deviated portion, and (iii) a high angle portion.

4. The method of claim 3, wherein the near vertical portion is a portion of the borehole having an angle of inclination of 30° or less relative to vertical, the deviated portion is a portion of the borehole having an angle of inclination of between 30° and 60° relative to vertical, and the high angle portion is a portion of the borehole having an angle of inclination of 60° or greater relative to vertical.

5. The method of claim 1, further comprising storing the first and second array of cuttings bed height-related values to a buffer.

6. The method of claim 5, wherein a size of the buffer is related to the repetition time.

7. The method of claim 1, wherein the parameter information and the additional parameter information include at least one of torque and drag, equivalent circulating density, equivalent static density, surface fluid parameter, and pressure.

8. The method of claim 1, further comprising predetermining the repetition time, wherein the repetition time is a time between generating and updating the cuttings bed model.

9. The method of claim 1, wherein the parameter information and the additional parameter information include at least one of drillstring component data and wellbore geometry.

10. The method of claim 1, wherein the parameter information and the additional parameter information include at least one of planned flow, fluid properties, and RPM.

11. A system for performing a cleaning operation in a borehole penetrating an earth formation, the system comprising:

one or more sensors configured to obtain parameter information related to one or more angles of inclination;

a control system configured to:

generate a cuttings bed model based on the obtained parameter information, the cuttings bed model providing a first array of cuttings bed height-related values for a portion of a depth of the borehole, the cuttings bed height-related values in the first array varying with the depth of the borehole, the portion of the depth of the borehole including the one or more angles of inclination;

obtain additional parameter information related to the one or more angles of inclination, update the cuttings bed model in a pseudo-transient manner using the additional parameter information, wherein updating the cuttings bed model in the pseudo transient manner includes updating the cuttings bed model after a repetition time to provide a second array of cuttings bed height-related values for the portion of the depth of the borehole, the cuttings bed height-related values in the second array varying with the depth of the borehole, compare the first array of cuttings bed height-related values to the second array of cuttings bed height-related values;

determine that a hole cleaning operation is necessary based on the comparing; and perform a hole cleaning operation.

12. The system of claim 11, wherein the hole cleaning operation includes a sweep pill operation.

13. The system of claim 11, wherein the parameter information and the additional parameter information are separated into information related to at least one of (i) a near vertical portion, (ii) a deviated portion, and (iii) a high angle portion.

14. The system of claim 13, wherein the near vertical portion is a portion of the borehole having an angle of inclination of 30° or less relative to vertical, the deviated portion is a portion of the borehole having an angle of inclination of between 30° and 60° relative to vertical, and the high angle portion is a portion of the borehole having an angle of inclination of 60° or greater relative to vertical.

15. The system of claim 11, wherein the control system is configured to store the first and second array of cuttings bed height related values to a buffer, and a size of the buffer is related to the repetition time.

16. The system of claim 11, wherein the control system is configured to predetermine the repetition time, and the repetition time is a time between generating and updating the cuttings bed model.

17. The system of claim 11, wherein the parameter information and the additional parameter information include at least one of torque and drag, equivalent circulating density, equivalent static density, surface fluid parameter, and pressure.

18. The system of claim 11, wherein the parameter information and the additional parameter information include static or semi-static parameters.

19. The system of claim 18, wherein the static or semi-static parameters include, at least, drillstring component data, BHA component data, and wellbore geometry.

20. The system of claim 11, wherein the parameter information and the addition parameter information include at least one of planned flow, fluid properties, and RPM.

* * * * *